US006464108B2

(12) United States Patent
Corba

(10) Patent No.: US 6,464,108 B2
(45) **Date of Patent: *Oct. 15, 2002**

(54) CONTAINER ASSEMBLY FOR DISPENSING NON-ATOMIZED COMPOSITION MIXED INTERNALLY UPON DISPENSING

(76) Inventor: Robert E. Corba, 4636 Stonebridge Dr., Racine, WI (US) 53404

( * ) Notice: Subject to any disclaimer, the term of this patent is extended or adjusted under 35 U.S.C. 154(b) by 0 days.

This patent is subject to a terminal disclaimer.

(21) Appl. No.: 09/898,312

(22) Filed: Jul. 3, 2001

(65) Prior Publication Data

US 2002/0003147 A1 Jan. 10, 2002

Related U.S. Application Data

(63) Continuation of application No. 09/609,780, filed on Jul. 5, 2000, now Pat. No. 6,325,248.

(51) Int. Cl.[7] ..... B65D 83/14
(52) U.S. Cl. ..... 222/136; 222/145.1; 222/389
(58) Field of Search ..... 222/135, 136, 222/389, 387, 402.1, 143.5, 145.1, 402.18, 514, 518

(56) References Cited

U.S. PATENT DOCUMENTS

| | | | | |
|---|---|---|---|---|
| 2,697,637 A | | 12/1954 | Mittelstadt | |
| 2,912,173 A | | 11/1959 | Edwards | |
| 2,952,278 A | | 9/1960 | Waldherr | |
| 3,101,876 A | | 8/1963 | Ayres | |
| 3,106,321 A | | 10/1963 | Gorman | |
| 3,123,261 A | | 3/1964 | Gorman | |
| 3,190,508 A | | 6/1965 | Petersen | |
| 3,248,015 A | | 4/1966 | De Giorgi | |
| 3,272,402 A | | 9/1966 | Frangos | |
| 3,283,963 A | | 11/1966 | Boyer et al. | |
| 3,333,744 A | | 8/1967 | Nilsen et al. | |
| 3,385,482 A | | 5/1968 | Frangos | |
| 3,421,662 A | | 1/1969 | Hanson | |
| 3,469,744 A | | 9/1969 | Corsette | |
| 3,482,784 A | | 12/1969 | Webster | |
| 3,508,689 A | | 4/1970 | Webster | |
| 3,521,859 A | | 7/1970 | Gronemeyer | |
| 3,525,456 A | | 8/1970 | Prussin et al. | |
| 3,542,253 A | | 11/1970 | Weber, III | |
| 3,583,604 A | | 6/1971 | Marand | |
| 3,598,290 A | * | 8/1971 | Steiman | 222/94 |
| 3,598,324 A | | 8/1971 | Macguire-Cooper | |
| 3,606,088 A | | 9/1971 | Baltzer | |
| 3,613,728 A | | 10/1971 | Steiman | |
| 3,664,557 A | | 5/1972 | Bruce | |
| 3,770,165 A | * | 11/1973 | Steiman et al. | 222/136 |
| 3,796,352 A | | 3/1974 | Morane | |
| 3,813,011 A | | 5/1974 | Harrison et al. | |
| 3,856,263 A | | 12/1974 | Macguire-Cooper | |
| 3,915,345 A | | 10/1975 | Harrison et al. | |
| 3,976,223 A | * | 8/1976 | Jass et al. | 222/94 |
| 3,977,575 A | | 8/1976 | Macguire-Cooper | |
| 3,982,668 A | * | 9/1976 | Riccio | 222/95 |
| 3,982,674 A | | 9/1976 | Mildern | |
| 4,062,475 A | | 12/1977 | Harris et al. | |
| 4,067,499 A | | 1/1978 | Cohen | |
| 4,340,154 A | | 7/1982 | VanManen | |
| 4,431,119 A | | 2/1984 | Stoody | |
| 4,471,893 A | | 9/1984 | Knickerbocker | |

(List continued on next page.)

*Primary Examiner*—Lesley D. Morris
*Assistant Examiner*—Patrick Buechner
(74) *Attorney, Agent, or Firm*—Jansson, Shupe & Munger, Ltd

(57) ABSTRACT

A container assembly (10) is provided for dispensing a mixture of a primary composition. The container assembly includes an outer container (12) extending along a longitudinal axis and defining a chamber (24) for receiving the primary composition. A collapsible inner container (62) is positioned within the outer container and defines a chamber (70) for receiving the secondary composition. A piston (38) is provided to simultaneously urge the primary composition from the outer container and the secondary composition from the inner container.

8 Claims, 4 Drawing Sheets

U.S. PATENT DOCUMENTS 4,493,444 A 1/1985 Del Bon et al.
4,585,149 A 4/1986 Zulauf
4,801,046 A 1/1989 Miczka
4,852,807 A 8/1989 Stoody
4,979,646 A 12/1990 Andris
5,115,944 A 5/1992 Nikolich
5,167,347 A * 12/1992 Wiegner et al.
5,238,150 A 8/1993 Williams
5,282,549 A 2/1994 Scholz et al.
5,285,966 A 2/1994 Czech
5,289,944 A * 3/1994 Weigner et al. ..... 222/1
5,353,962 A 10/1994 Scholz et al.
5,449,094 A 9/1995 Behar et al.
5,456,386 A 10/1995 Jesswein
5,522,526 A 6/1996 DeLaforcade et al.
5,551,601 A 9/1996 Camm et al.
5,647,510 A 7/1997 Keller
5,662,271 A 9/1997 Weston et al.
5,772,083 A 6/1998 Joulia
5,845,716 A 12/1998 Birk
5,895,029 A 4/1999 Lacout
5,915,595 A 6/1999 Dow et al.
5,915,598 A 6/1999 Yazawa et al.
5,927,563 A 7/1999 Kellner
5,947,335 A 9/1999 Milio et al.
6,325,248 B1 * 12/2001 Corba ..... 222/136

* cited by examiner

CONTAINER ASSEMBLY FOR DISPENSING NON-ATOMIZED COMPOSITION MIXED INTERNALLY UPON DISPENSING

RELATED APPLICATIONS

This is a continuation of my patent application Ser. No. 09/609,780, filed Jul. 5, 2000, now U.S. Pat. No. 6,325,248.

FIELD OF THE INVENTION

This invention relates generally to containers, and in particular, to a container assembly which contains a plurality of compositions to be mixed upon discharge therefrom.

BACKGROUND OF THE INVENTION

It is known to provide a dispensing container which provides for the dispensing of more than one flowable substance contained therein through a single nozzle. Typically, these types of dispensing containers include separate compartments for receiving corresponding compositions prior to use. The nozzle releases the compositions from their compartments and from the dispensing container. A chamber is provided for mixing the compositions just prior to flowing from the nozzle since many compositions cannot be mixed until use.

In view of the foregoing, dispensing containers must be capable of mixing the compositions stored therein in proper proportions and only in those amounts required for use at one time. In order to insure that properly metered amounts of the compositions are mixed, various types of dispensing containers have been developed. For example, U.S. Pat. No. 3,813,011 (Harrison et al.) discloses various types of dispensing containers which utilize two concentric compartments for storing the compositions to be mixed. Referring to the embodiment shown in FIG. 5 of the Harrison et al. '011 patent, dispensing container includes a container body, a bellows container and a piston. An inner air compartment is provided inside of the bellows container and an outer compartment is provided in the space between the bellows container and the container body. When the valve assembly is actuated, the piston moves axially upward in the container body so as to collapse the bellows container and to force the material contained in the bellows container along with the material in the outer compartment into a mixing chamber in the valve assembly. Materials flow into the mixing chamber in a fixed volumetric ratio because the volume of the bellows container and the volume of the outer compartment are reduced in a fixed ratio.

While functional for its intended purpose, the dispensing container disclosed in the Harrison et al. '011 patent has limitations. For example, the ratio of mixture of the composition within the bellows container and the composition within the outer compartment is limited since the bellows container must be engaged with the piston in order for the piston to force material from the inner compartment within the bellows container. Further, due to the shape of the piston, not all of the contents of the outer container can be forced therefrom by the piston. As a result, a certain portion of the composition in the outer compartment of the dispensing container is wasted thereby increasing the cost of the product. In addition, since the bottom portion of the bellows container does not mesh with the upper surface of the piston, the bellows container may not collapse upon itself. This, in turn, may result in the uneven dispensing of the composition in the inner compartment thereby altering the ratio of the compositions in the mixture.

Other examples of prior dispensing containers for dispensing two flowable compositions are those disclosed in U.S. Pat. No. 3,976,223 (Jass et al.), U.S. Pat. No. 3,474,934 (Forim) and U.S. Pat. No. 3,982,668 (Riccio). The Riccio '668 patent discloses an aerosol dispenser, i.e., a dispenser for dispensing an atomizing mixture, and among other things would be incapable of dispensing two substances at a substantially constant ratio. The device of the Jass et al. '223 patent, as opposed to involving mixing in the valve stem, at most discloses mixing in the nozzle itself or what amounts to separate, though simultaneous, dispensing of two compositions. Furthermore, the Jass el al. device would not allow high-ratio fixed-ratio dispensing—i.e., dispensing of mixtures of a very large amount of a primary composition with a very small amount of a secondary composition. The mixing of the device of the Forim '934 patent is less controlled than desirable and, like the Jass et al. patent, cannot allow high-ratio fixed-ratio dispensing.

To summarize, the devices of the prior art have very significant functional shortcomings rendering them unacceptable for various significant applications. This invention is directed to providing a dispensing container which overcomes problems and shortcomings in the prior art and is a highly significant device for co-dispensing applications.

OBJECTS OF THE INVENTION

Therefore, it is a primary object and feature of the present invention to provide a container assembly which allows for a predetermined fixed ratio of compositions in a mixture to be dispensed therefrom.

Another object of this invention is to provide a container for dispensing two compositions in a very high ratio of primary composition to secondary composition.

Another object and feature of the present invention to provide a container assembly for holding a plurality of compositions which allows such compositions be dispensed from the container assembly in their entireties.

It is still a further object and feature of the present invention to provide a container assembly which is simple and inexpensive to manufacture.

BRIEF SUMMARY OF THE INVENTION

In accordance with the present invention, a container assembly is provided for dispensing a mixture of a primary composition and a secondary composition. The container assembly includes a container extending along a longitudinal axis and defining a chamber for receiving the primary composition therein. A collapsible inner container is positioned within the outer container and defines a chamber for receiving the secondary composition therein. A dispensing structure simultaneously urges the primary composition from the outer container and a secondary composition from the inner container. A mixing valve is provided in communication with the outer and inner containers. The mixing valve is movable between a first closed position wherein the primary composition is retained in the outer container and the secondary composition is retained in the inner container, and a second opened position wherein the primary compositions and the secondary compositions are mixed to form the mixture for release from the container assembly.

A valve housing is positioned about the mixing valve. The valve housing includes a mixing chamber therein wherein the primary composition and the secondary composition are mixed. The valve housing is integral with the inner container.

It is contemplated that the primary composition is urged from the outer container and the secondary composition is urged from the inner container in a predetermined ratio. The dispensing structure for urging the compositions from the corresponding containers includes a piston disposed in the outer container. The piston divides the chamber of the outer container to a first portion for receiving the primary composition and the inner container therein and a second portion. A compressed gas is disposed in the second portion of the chamber of the outer container. The compressed gas urges the piston against the primary composition in the first portion of the chamber of the outer container.

The inner container extends along the longitudinal axis of the outer container and includes a terminal end. The piston includes an upper surface having a first portion complementary to the terminal end of the inner container. The inner container further includes a longitudinally extended wall having baffles formed therein for facilitating the collapse thereof. The inner container collapses axially along the longitudinal axis of the outer container. It is contemplated that the outer container includes an upper end which is complementary to a second portion of the upper surface of the piston.

In accordance with a still further aspect of the present invention, a container assembly is provided for dispensing a mixture of a primary composition and a secondary composition. The container assembly includes an outer container extending along a longitudinal axis and defining a chamber for receiving the primary composition therein. A collapsible inner container is positioned within the outer container and defines a chamber for receiving the secondary composition. A dispensing member is positioned within the outer container for simultaneously urging the primary composition from the outer container and the secondary composition from the inner container. Dispensing member is movable between the first position spaced from the inner container and a second position in engagement with the inner container.

A mixing valve is provided in communication with the outer and inner containers. The mixing valve is movable between a first closed position wherein the primary composition is retained in the outer container and a secondary composition is retained in the inner container and a second opened position wherein the primary composition and the secondary composition are mixed to form the mixture for release from the container assembly. A valve housing is positioned about the mixing valve. The valve housing includes a mixing chamber therein wherein the primary composition and the secondary composition are mixed. The valve housing is integral with the inner container.

It is contemplated that the primary composition be urged from the outer container and the secondary composition be urged from the inner container in a predetermined ratio. The dispensing member which urges the compositions from their corresponding containers includes a piston disposed in the outer container. The piston divides the chamber of the outer container into a first portion for receiving the primary composition and the inner container therein and a second portion having compressed gas disposed therein. The compressed gas urges the piston between the first and second positions.

It is contemplated that the inner container extend along the longitudinal axis of the outer container and include a terminal end. The piston includes an upper surface complementary to the terminal end of the inner container. The inner container also includes a longitudinally extending sidewall having baffles therein for facilitating the collapse thereof.

In accordance with a still further aspect of the present invention, a container assembly is provided for dispensing a mixture of a primary composition and a secondary composition. The container assembly includes an outer container extending along a longitudinal axis and defining a chamber for receiving the primary composition therein. A collapsible inner container is in position within the outer container and defines a chamber for receiving the secondary composition therein. The inner container includes a terminal end and a sidewall having baffles therein. A piston having an upper surface complementary to the terminal end of the inner container is disposed within the outer container for simultaneously urging the primary composition from the outer container and the secondary composition from the inner container. The piston is movable between a first position spaced from the inner container and a second position wherein the upper surface of the piston is in engagement with the terminal end of the inner container. A compressed gas is disposed in the outer container. The compressed gas moving the piston from the first to the second position.

A mixing valve is provided in communication with the outer and inner containers. The mixing valve is movable between a first closed position wherein the primary composition is retained in the outer container and the secondary composition is retained in the inner container, and a second opened position wherein the primary composition and the secondary composition are mixed to form the mixture for release from the container. A valve housing is positioned about the mixing valve. The valve housing includes a mixing chamber therein wherein the primary composition and the secondary position are mixed. The valve housing is integral with the inner container. It is contemplated that the primary composition and the secondary composition are mixed in a predetermined ratio.

BRIEF DESCRIPTION OF THE DRAWINGS

The drawings illustrate a preferred embodiment of the invention in which the above features are shown as well as others which will be readily understood from the following description of the illustrated embodiment. In the drawings.

DETAILED DESCRIPTION OF THE DRAWINGS

Figure 1:
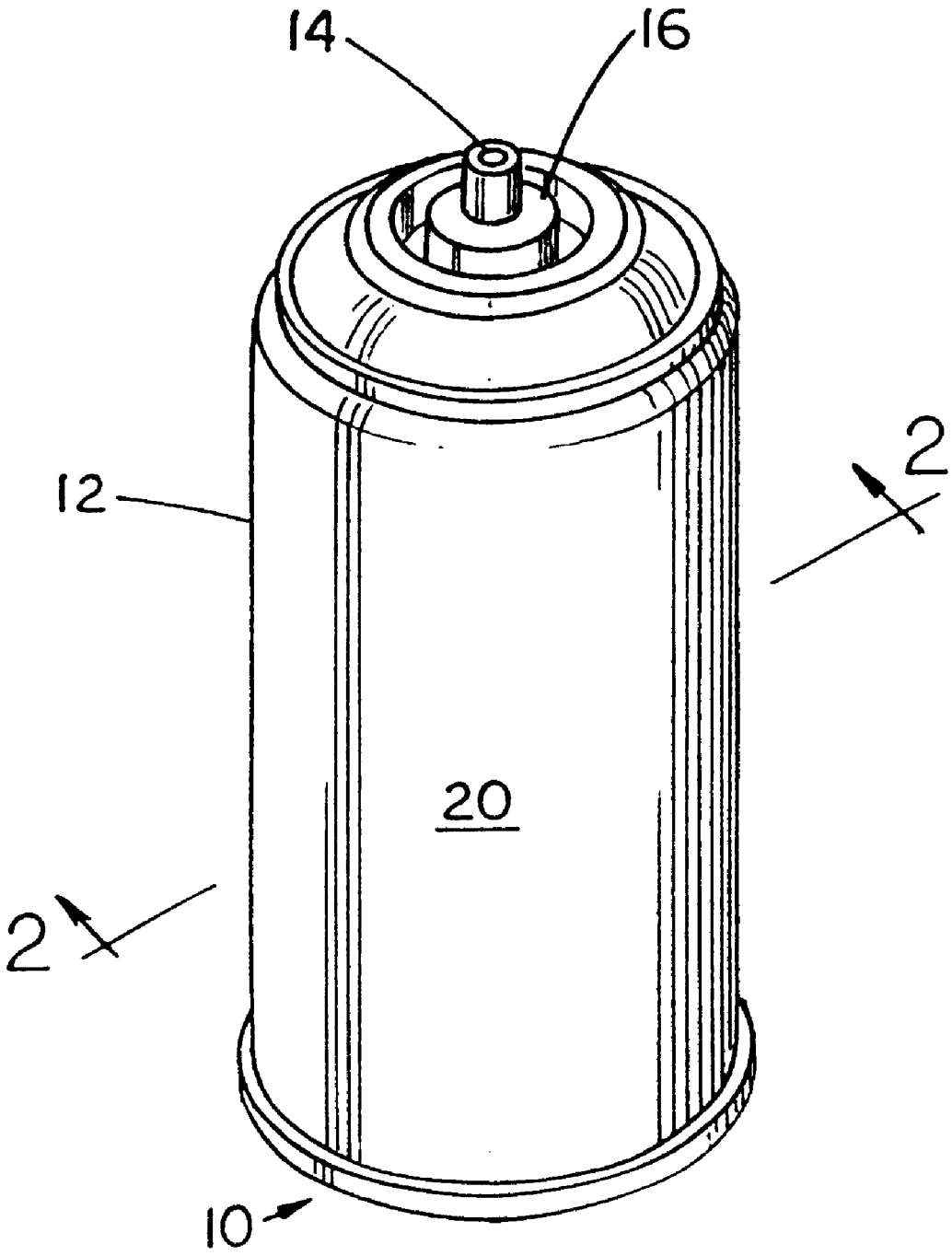
FIG. 1 is an isometric view of a container assembly in accordance with the present invention.

Referring to FIG. 1, a container assembly in accordance with the present invention is generally designated by the reference numeral 10. As is conventional, container 10 includes an outer shell 12, a nozzle 14 and a valve assembly 16. As hereinafter described, depression of nozzle 14 results in a dispensing of a mixture of a primary and a secondary composition which are stored within container assembly 10.

Outer shell 12 of container assembly 10 includes a generally tubular side wall 18 having an outer surface 20 and an inner surface 22 defining a first chamber 24 within container assembly 10. Side wall 18 includes a first end 26 closed by a bottom wall 28 and an opposite second end 30 having an opening 32 therein for accommodating valve assembly 16. Second end 30 of outer shell 12 includes first and second longitudinally spaced stop surfaces 34 and 36, respectively, for reasons hereinafter described.

A piston 38 is disposed within first chamber 24 in outer shell 12 and divides first chamber 24 into a first portion 40 for receiving the primary composition therein and a second portion 42 for receiving a compressed gas therein. Piston 38 includes a first sealing portion 44 having an outer surface 46 engaging the inner surface 22 of a side wall 18 such that the interface 48 therebetween forms a seal to retain the primary composition within the first portion 40 of first chamber 24 and to retain the compressed gas within the second portion 42 of first chamber 24.

Piston 38 further includes a stopping surface 50 which is longitudinally aligned with stop surface 34 on the second end 30 of outer shell 12 and a second stopping surface 52 which is longitudinally aligned with second stop surface 36 on second end 30 of outer shell 12. Stopping surface 52 includes a depression 54 therein which defines an inner container receiving cavity 56. Depression 54 includes a bottom portion 58 which is complementary to the bottom portion 60 of inner container 62.

Inner container 62 extends along the longitudinal axis of outer shell 12 and is positioned within the first portion 40 of first chamber 24 within outer shell 12. Inner container 62 includes a generally baffled-shaped side wall 64 having an outer surface 66 in communication with first portion 40 of first chamber 24 in outer shell 12 and an inner surface 68 which defines a second chamber 70 within container assembly 10. Side wall 64 includes a first end 72 which is closed by bottom portion 60 of inner container 62 and an opposite, second end 74.

A valve housing 76 projects longitudinally from the second end 74 of inner container 62. Valve housing 76 includes a generally cylindrical side wall 78 having a first end 80 integrally formed with second end 74 of inner container 62 and an opposite, second end 82 having a radially extending seal 84 formed thereabout. Inner surface 86 of side wall 78 of valve housing 78 defines a flow chamber 88 therein.

Figure 3:
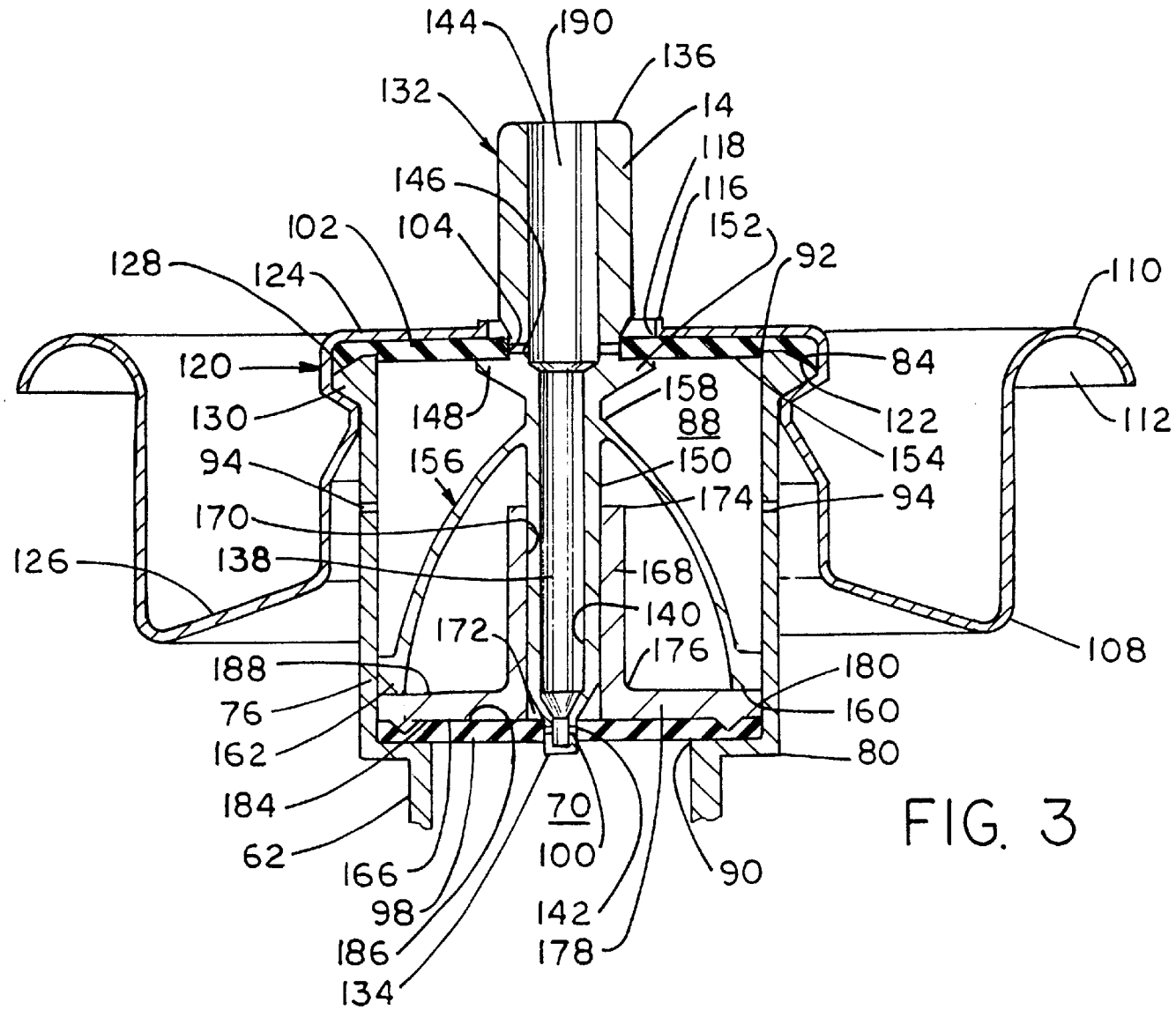
FIG. 3 is an enlarged, cross-sectional view of a valve assembly in a non-actuated position for use in the container assembly in the present invention.
Figure 4:
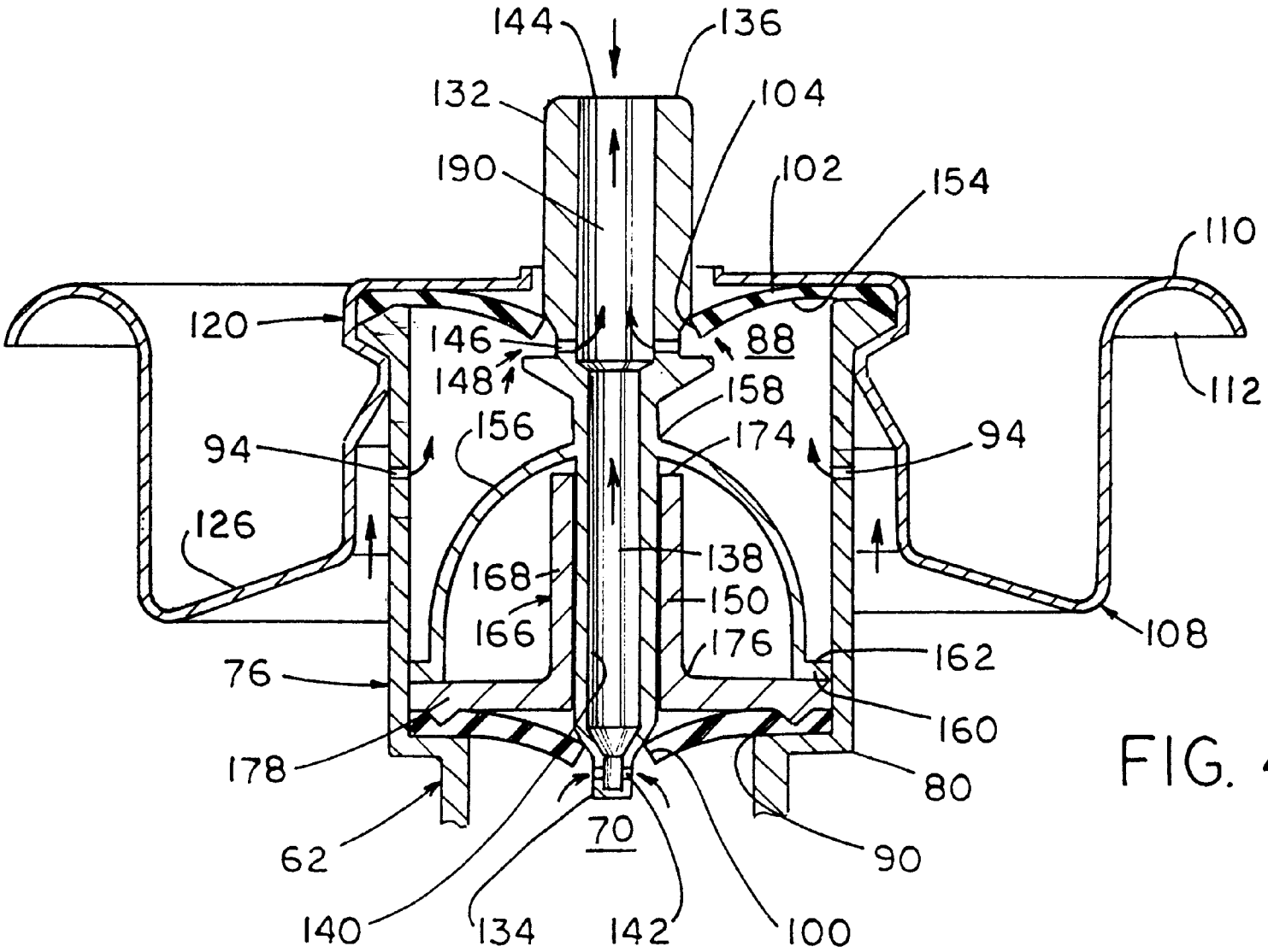
FIG. 4 is an enlarged, cross-sectional view of the valve assembly of FIG. 3 in an actuated position.

Referring to FIGS. 3–4, valve housing 76 further includes an lower opening 90 in first end 80 thereof and an upper opening 92 in second end 82 thereof. A plurality of flow openings 94 are provided in side wall 78 so as to allow first portion 40 of first chamber 24 to communicate with flow chamber 88 within valve housing 76. Lower seal 98 is disposed within valve housing 76 across lower opening 90 therein so as to isolate flow chamber 88 within valve housing 76 from second chamber 70 within inner container 62. Lower seal 98 includes an opening 100 therethrough for reasons hereinafter described. Similarly, an upper seal 102 is positioned over upper opening 92 in order to isolate flow chamber 88 within valve housing 76 from the environment external of container assembly 10. Seal 102 includes an opening 104 therein for reasons hereinafter described.

A connection member 108 interconnects valve housing 76 to second end 30 of side wall 18 of outer shell 12. Connection member 108 includes a semi-spherical, radially outer edge 110 which defines a recess 112 therein for receiving terminal edge 114 of second end 30 of outer shell 12. Connection member 108 further includes a radially inner edge 116 defining an opening 108 which overlaps and is in axial alignment with opening 104 in upper seal 102. Connection member 108 further includes a generally C-shaped retaining clip 120 defining a cavity 122 opening radially inwardly towards a longitudinally axis of container assembly 10. Retainer clip 120 is interconnected to radially inner edge 116 of connection member 108 by a generally flat plate 124 and is interconnected to radially outer edge 110 of connection member 108 by a generally U-shaped element 126. Cavity 122 in retaining clip 120 is adapted to capture radially outer edge 128 of upper seal 102 and radial seal 84 about second end 82 of valve housing 76 thereby interconnecting valve housing 76 to outer shell 12.

A valve stem 132 extends along the longitudinal axis of outer shell 12 and through opening 118 defined by radially inner edge 116 of connection member 108; opening 104 in upper seal 102; and opening 100 in lower seal 98. Valve stem 132 includes an inlet end 134 disposed within second chamber 70 of inner container 62 and an outlet end 136 disposed externally of container assembly 10. Outlet end 136 includes nozzle 14 formed thereon.

A longitudinally extending passageway 138 is defined by inner surface 140 of valve stem 132. An inlet 142 to passageway 138 is provided at the inlet end 134 of valve stem 132 and an outlet 144 of passageway 138 is provided at the outlet end 136 of valve stem 132. A mixing opening 146 to passageway 138 is disposed between the inlet and outlet ends 134 and 136, respectively, of valve stem 132. As best seen in FIG. 3, inlet 142 and mixing opening 146 in valve stem 132 are longitudinally spaced along valve stem 132 such that with valve stem 132 in a non-depressed position, inlet 142 is closed by engagement with lower seal 98 and mixing opening 146 is closed by engagement with upper seal 102. A mixing portion 190 is disposed between mixing opening 146 and outlet 144 of passageway 138.

Valve stem 132 further includes a sealing structure 148 projecting radially from the outer surface 150 thereof at a location adjacent mixing opening 146. Upper surface 152 of sealing structure 148 engages lower surface 154 of upper seal 102 with valve stem 132 in a non-depressed position, FIG. 3, in order to isolate flow chamber 88 from the environment external of container assembly 10 and to further maintain closure of mixing opening 146.

A generally concave, bell-shaped biasing structure 156 depends from the outer surface 150 of valve stem 132. Biasing structure 156 includes a first radially inner end 158 which is integrally formed with valve stem 132 and a second, opposite terminal end 160 which is radially spaced from outer surface 150 of valve stem 132. A radial seal 162 is formed about terminal end 160 of biasing structure 156 and engages inner surface 86 of side wall 78 of valve housing 76. Biasing structure 156 urges valve stem 132 towards the non-depressed position, FIG. 3.

A generally tubular limiter member 166 includes a first vertical portion 168 having an inner surface 170 defining a passageway 172 for receiving valve stem 132 therethrough. Limiter member 166 includes a first end 174 and a second opposite end 176. A generally flat disc 178 projects radially from second end 176 of limiter member 166 and terminates at a radially outer edge 180 which engages inner surface 86 of sidewall 78 of valve housing 76. Disc 178 includes a lower surface 184 which engages upper surface 186 of lower seal 98 and an upper surface 188 which is engaged by terminal end 160 of biasing structure 156.

Figure 2:
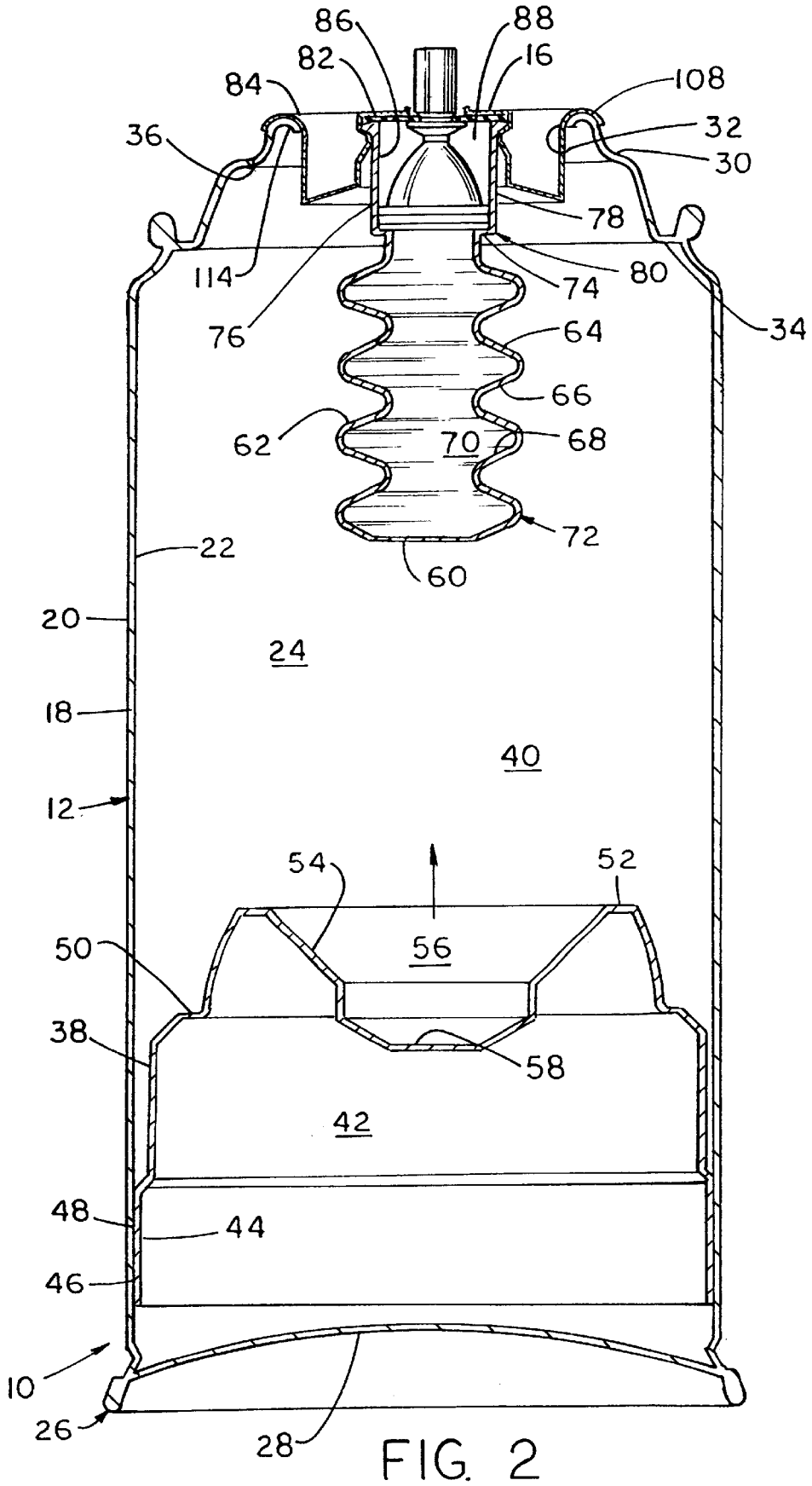
FIG. 2 is a cross-sectional view of the container assembly taken along line 2—2 of FIG. 1.

In operation, first portion 40 of first chamber 24 within outer shell 12 is filled with a primary composition and second chamber 70 within inner container 62 is filled with a secondary composition. Compressed gas is disposed within the second portion 42 of first chamber 24 so as to urge piston 38 outwardly in FIG. 2 during the expansion thereof.

Biasing structure 156 urges valve stem 132 towards a non-depressed position, FIG. 3. With valve stem 132 in a non-depressed position, the primary composition enters flow chamber 88 within valve housing 76 through flow openings 94 therein. The primary composition is urged into flow chamber 88 by piston 38 which is urged upwardly by the compressed gas contained in second portion 42 of first chamber 24 of outer shell 12.

As valve stem 132 is depressed, FIG. 4, inlet 142 in inlet end 134 thereof is received within second chamber 70 within inner container 62 such that passageway 138 within valve stem 132 is in communication with second chamber 70 within inner container 62. Similarly, with valve stem 132 in the depressed position, FIG. 4, mixing opening 146 is positioned within flow chamber 88 within valve housing 76 such that passageway 138 within valve stem 132 is in communication with flow chamber 88 within valve housing 76. Valve stem 132 may be depressed against the bias of biasing structure 156 until such point that biasing structure 156 engages first end 174 of limiter member 166. As described, the path of valve stem 132 is limited between the non-depressed position, FIG. 3, wherein sealing structure 148 of valve stem 132 engages the lower surface 154 of upper seal 102 and a depressed position wherein biasing structure 156 engages first end 174 of limiter member 166.

With valve stem 132 in the depressed position, FIG. 4, the compressed gas in second portion 42 of first chamber 24 urges piston 38 upward such that the primary composition in the first portion 40 of first chamber 24 exerts pressure on and begins to collapse inner container 62 thereby urging secondary composition within chamber 70 through inlet 142 in valve stem 132 and into passageway 138. In addition, the primary composition is urged from flow chamber 88 within valve housing 76 into passageway 138 within valve stem 132 through mixing opening 146. The primary and secondary compositions are mixed within a mixing portion 190 of passageway 138 in valve stem 132 and discharged through outlet 144 in nozzle 14. Thereafter, valve stem 132 may be released such that biasing structure 156 urges valve stem 132 to the non-depressed position, FIG. 3. The process may be repeated each time a user wishes to discharge the mixture from container assembly 10.

With each subsequent depression of valve stem 132, piston 38 will move upwardly within outer shell 12 of container assembly 10 as the compressed gas within second portion 42 of first chamber 24 expands. In addition, inner container 62 will collapse axially on itself due to the presence of the baffles in side wall 64 of inner container 62. Further, the volume of the primary composition in first portion 40 of first chamber 24 and the volume of the second chamber 70 within inner container 62 may be selected such that the mixture dispensed from container assembly 10 has a predetermined ratio of second composition to primary composition. The ratio of secondary composition to primary composition dispensed from container assembly 10 may also be modified by varying sizes of inlet 142 and mixing opening 146 in valve stem 132.

Various modes of carrying out the invention are contemplated as being within the scope of the following claims particularly pointing out and distinctly claiming the subject matter which is regarded as the invention.

What is claimed is:

1. A container assembly for dispensing a mixture of a primary composition and a secondary composition, comprising:

an outer container extending along a longitudinal axis and defining a chamber for receiving the primary composition therein;

a collapsible inner container positioned within the outer container and defining a chamber for receiving the secondary composition therein;

a dispensing structure for simultaneously urging the primary composition from the outer container and the secondary composition from the inner container, the dispensing structure dividing the chamber of the outer container into first and second portions, the first portion receiving the primary composition and the inner container therein and the second portion having a gas disposed therein isolated from the compositions throughout dispensing, the gas urging the dispensing structure against the primary composition in the first portion of the chamber of the outer container and the primary composition urging the inner container against the secondary composition; and a mixing valve in communication with the outer and inner containers, the mixing valve including a valve stem movable between a first closed position wherein the primary composition is retained in the outer container and the secondary composition is retained in the inner container and a second open position wherein the primary and secondary compositions are mixed in the valve stem to form the mixture for release from the container assembly, wherein the dispensing structure urges the primary composition from the outer container and the primary composition urges the secondary composition from the inner container in a predetermined substantially constant ratio.

2. The container assembly of claim 1 further comprising a valve housing about the valve stem.

3. The container assembly of claim 1 wherein the dispensing structure is a piston.

4. The container assembly of claim 3 wherein the gas is a compressed gas.

5. The container assembly of claim 3 wherein the inner container extends along the longitudinal axis of the outer container and includes a terminal end and wherein the piston includes an upper surface having a first portion complementary to the terminal end of the inner container.

6. The container assembly of claim 5 wherein outer container includes an upper end and wherein the upper surface of the piston includes a second portion complementary to the upper end of the outer container.

7. The container assembly of claim 1 wherein the inner container includes a longitudinally extending sidewall having baffles formed therein for facilitating the collapse thereof.

8. The container assembly of claim 1 wherein the inner container collapses axially along the longitudinal axis of the outer container.

* * * * *